US008726786B2

(12) United States Patent
Miki et al.

(10) Patent No.: US 8,726,786 B2
(45) Date of Patent: May 20, 2014

(54) STACK VALVE HAVING BUCKET PARALLEL MOVEMENT FUNCTION

(75) Inventors: Takashi Miki, Kobe (JP); Yasunori Hatanaka, Kobe (JP)

(73) Assignee: Nabtesco Corporation, Tokyo (JP)

( * ) Notice: Subject to any disclaimer, the term of this patent is extended or adjusted under 35 U.S.C. 154(b) by 749 days.

(21) Appl. No.: 12/999,320

(22) PCT Filed: Jun. 12, 2009

(86) PCT No.: PCT/JP2009/060725
§ 371 (c)(1),
(2), (4) Date: Dec. 16, 2010

(87) PCT Pub. No.: WO2009/154140
PCT Pub. Date: Dec. 23, 2009

(65) Prior Publication Data

US 2011/0088798 A1 Apr. 21, 2011

(30) Foreign Application Priority Data

Jun. 16, 2008 (JP) ..... 2008-157043

(51) Int. Cl.
*F15B 13/06* (2006.01)

(52) U.S. Cl.
USPC ..... 91/515

(58) Field of Classification Search
USPC ..... 91/515, 520; 417/700
See application file for complete search history.

(56) References Cited

U.S. PATENT DOCUMENTS

| | | | | |
|---|---|---|---|---|
| 7,032,378 | B2 * | 4/2006 | Ioku et al. | 91/515 |
| 7,059,237 | B2 * | 6/2006 | Ioku et al. | 91/515 |
| 7,357,064 | B2 * | 4/2008 | Kauss | 91/515 |
| 7,434,394 | B2 * | 10/2008 | Ishikawa et al. | 91/520 |
| 7,549,241 | B2 * | 6/2009 | Ioku et al. | 60/421 |
| 7,895,833 | B2 * | 3/2011 | Kajita et al. | 91/520 |
| 2004/0231505 | A1 | 11/2004 | Ioku et al. | |
| 2004/0250677 | A1 | 12/2004 | Ioku et al. | |
| 2007/0006491 | A1 | 1/2007 | Ioku et al. | |
| 2011/0232787 | A1 * | 9/2011 | Miki | 137/565.19 |

FOREIGN PATENT DOCUMENTS

| | | | |
|---|---|---|---|
| JP | 11-030205 | A | 2/1999 |
| JP | 11-230106 | A | 8/1999 |
| JP | 2004-340313 | A | 12/2004 |
| JP | 2005-002668 | A | 1/2005 |
| JP | 2007-016483 | A | 1/2007 |
| JP | 2007-016484 | A | 1/2007 |
| JP | 2007-321807 | A | 12/2007 |

OTHER PUBLICATIONS

Korean Office Action for Application No. 10-2011-7000945, mailed on Oct. 8, 2012 (11 pages).

(Continued)

*Primary Examiner* — Michael Leslie
(74) *Attorney, Agent, or Firm* — Osha Liang LLP

(57) ABSTRACT

A stack valve 1 includes an ascending dividing valve 14 which is provide on an ascending junction path 23 and controls the flow rate of a pressure fluid supplied to a head-side chamber 4*a* of a bucket cylinder 4, an ascending branched path 24 which is branched from the ascending junction path 23 and connected to an unloading path 21, and an ascending cancellation switching valve 19 which is provided on the ascending branched path 24 to close or open the ascending branched path 24. The ascending dividing valve 14 and the ascending cancellation switching valve 19 are provide in the same dividing section 83.

4 Claims, 5 Drawing Sheets

(56) References Cited

OTHER PUBLICATIONS

International Search Report International Preliminary Report on Patentability and Written Opinion Application No. PCT/ JP2009/060725 mailed Jan. 20, 2011 (6 pages).

International Search Report w/translation from PCT/JP2009/060725 dated Jul. 7, 2009 (4 pages).

Espacenet Abstract of JP11030205A dated Feb. 2, 1999; Hitachi Construction Machinery (1 page).

Espacenet Abstract of JP11230106A dated Aug. 27, 1999; Kayaba Industry Co. Ltd. (1 page).

* cited by examiner

STACK VALVE HAVING BUCKET PARALLEL MOVEMENT FUNCTION

TECHNICAL FIELD

The present invention relates to a stack valve having a bucket parallel movement function of keeping a bucket in parallel to the horizontal plane when a boom is driven by supplying a pressure fluid to a boom cylinder, by supplying a return pressure fluid from a bucket cylinder to the boom cylinder.

BACKGROUND ART

An example of the technologies belonging to the same technical field is recited in Patent Document 1. A stack valve having a bucket parallel movement function according to Patent Document 1 includes a dividing valve which divides a return pressure fluid from a boom cylinder into a flow toward a junction path and a flow toward a bypass path, a branched path which is branched from the junction path and connected to an unloading path, and a switching valve which is provided on the branched path and opens or closes the branched path. This stack valve of Patent Document 1 makes it possible to return the pressure fluid to the unloading path via the branched path branched from the junction path and to prevent a pressure from occurring in the branched path. By the switching valve on the branched path, the flow of the return pressure fluid from the boom cylinder to the bucket cylinder is stopped, and hence the bucket parallel movement function is suitably cancelled.

PATENT DOCUMENTS

[Patent Document 1] Japanese Unexamined Patent Publication No. 2004-340313

DISCLOSURE OF THE INVENTION

However, the stack valve having the bucket parallel movement function according to Patent Document 1 is arranged so that the switching valve opening or closing the branched path is provided in a section adjacent to the section in which the dividing valve is provided (see FIGS. 2 and 4 in Patent Document 1). When newly-required functions such as descending and ascending sequence valves and a float electromagnetic valve are added to the stack valve above, the size of the stack valve becomes large.

The present invention was done to solve the problem above, and an object of the present invention is to provide a stack valve having a bucket parallel movement function, which is not large in size, i.e. is smaller than conventional valves.

To achieve the object above, the present invention provides a stack valve having a bucket parallel movement function, which includes: an unloading path connected to a fluid pressure source, a tank path connected to a tank; a boom direction switching valve which is provided in a boom section and connected to the unloading path to control supply of a pressure fluid from the fluid pressure source to a boom cylinder; a bucket direction switching valve which is provided in a bucket section and connected to the unloading path to control supply of the pressure fluid from the fluid pressure source to the bucket cylinder; an ascending junction path which supplies the pressure fluid from a rod-side chamber of the boom cylinder to a head-side chamber of the bucket cylinder via the boom direction switching valve; an ascending dividing valve which is provided in a dividing section and connected to the ascending junction path to control a flow rate of the pressure fluid supplied to the head-side chamber of the bucket cylinder; an ascending branched path which is branched from the ascending junction path and connected to the unloading path or the tank path; and a ascending cancellation switching valve which is provided in the dividing section and connected to the ascending branched path to open or close the ascending branched path.

According this arrangement, since the ascending cancellation switching valve and the ascending dividing valve are provided in the same dividing section, it is possible to eliminate a section for the ascending cancellation switching valve. This makes it possible to realize a stack valve which is small in size as compared to conventional ones, i.e. to provide a small-sized stack valve having a bucket parallel movement function.

In the present invention, in addition to the above, the stack valve is preferably arranged to further comprise: a descending junction path which supplies the pressure fluid from a head-side chamber of the boom cylinder to the rod-side chamber of the bucket cylinder via the boom direction switching valve; a descending dividing valve which is provided in the dividing section and on the descending junction path to control a flow rate of the pressure fluid supplied to the rod-side chamber of the bucket cylinder; a descending branched path which is branched from the descending junction path and connected to the unloading path or the tank path; and a descending cancellation switching valve which is provided in the dividing section and on the descending branched path to open or close the descending branched path, wherein, the descending dividing valve and the ascending dividing valve are arranged to be in parallel to each other, the ascending dividing valve is provided on one side of the dividing section whereas the descending dividing valve is provided on the other side of the dividing section, and the ascending cancellation switching valve is provided on the same axis as the descending dividing valve and in the one side of the dividing section.

According to this arrangement, since the ascending cancellation switching valve and the ascending dividing valve are provided on the same side in the dividing section, it is possible to simplify a path connecting the ascending cancellation switching valve with the ascending dividing valve.

In addition to the above, the present invention is preferably arranged so that the ascending cancellation switching valve has a cup-shaped plug in which a spool hole is formed, and the descending dividing valve and the ascending cancellation switching valve on the same axis are bordered with each other at a bottom portion of the plug.

This arrangement allows a housing space (spool hole) of the descending dividing valve and the ascending cancellation switching valve by a single manufacturing step, thereby making it possible to form the spool hole.

The second aspect of the present invention provides a stack valve having a bucket parallel movement function, comprising: an unloading path connected to a fluid pressure source; a tank path connected to a tank; a boom direction switching valve which is provided in a boom section and connected to the unloading path to control supply of a pressure fluid from the fluid pressure source to a boom cylinder; a bucket direction switching valve which is provided in a bucket section and connected to the unloading path to control supply of the pressure fluid from the fluid pressure source to a bucket cylinder; a descending junction path which supplies the pressure fluid from a head-side chamber of the boom cylinder to a rod-side chamber of the bucket cylinder via the boom direction switching valve; a descending dividing valve which is provided in a dividing section and on the descending junction path to control a flow rate of the pressure fluid supplied to the rod-side chamber of the bucket cylinder; a descending branched path which is branched from the descending junction path and connected to the unloading path or the tank path; and a descending cancellation switching valve which is provided in the dividing section and on the descending branched path to open or close the descending branched path.

According to this arrangement, since the descending cancellation switching valve and the descending dividing valve are provided in the same dividing section, it is possible to eliminate a section for the descending cancellation switching valve. This makes it possible to realize a stack valve which is small in size as compared to conventional ones, i.e. to provide a small-sized stack valve having a bucket parallel movement function.

In addition to the above, the stack valve is preferably arranged to further include: an ascending junction path which supplies the pressure fluid from the rod-side chamber of the boom cylinder to the head-side chamber of the bucket cylinder via the boom direction switching valve; an ascending dividing valve which is provided in the dividing section and on the ascending junction path to control a flow rate of the pressure fluid supplied to the head-side chamber of the bucket cylinder; an ascending branched path which is branched from the ascending junction path and connected to the unloading path or the tank path; and an ascending cancellation switching valve which is provided in the dividing section and on the ascending branched path to open or close the ascending branched path, wherein, the descending dividing valve and the ascending dividing valve are arranged to be in parallel to each other, the ascending dividing valve is provided on one side of a dividing section whereas the descending dividing valve is provided on the other side of the dividing section, and the descending cancellation switching valve is on the same axis as the ascending dividing valve and is provided in the other side of the dividing section.

According to this arrangement, since the descending cancellation switching valve and the descending dividing valve are provided in the same other side of the dividing section, it is possible to simplify a path connecting the descending cancellation switching valve with the descending dividing valve.

In addition to the above, the present invention is preferably arranged so that the descending cancellation switching valve has a cup-shaped plug in which a spool hole is formed, and the ascending dividing valve and the descending cancellation switching valve on the same axis are bordered with each other at a bottom portion of the plug.

This arrangement allows a housing space (spool hole) of the ascending dividing valve and the descending cancellation switching valve by a single manufacturing step, thereby making it possible to form the spool hole.

BEST MODE FOR CARRYING OUT THE INVENTION

The following will describe an embodiment of the present invention with reference to figures.

(Structure of Stack Valve)

Figure 1:
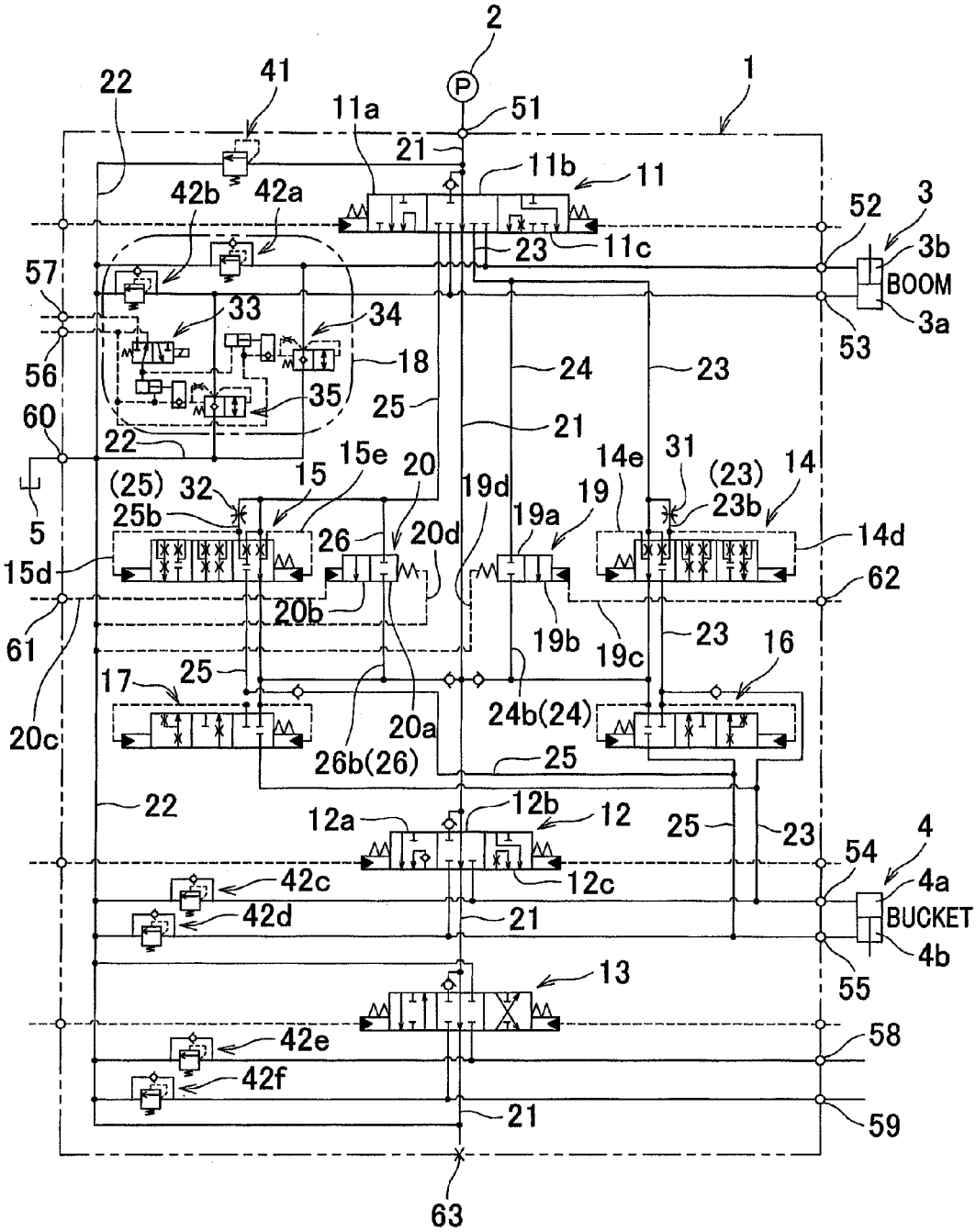
FIG. 1 is a hydraulic circuit diagram showing a stack valve having a bucket parallel movement function according to an embodiment of the present invention.

FIG. 1 is a hydraulic circuit diagram showing a stack valve 1 having a bucket parallel movement function (hereinafter, stack valve 1) according to an embodiment of the present invention.

The stack valve 1 is used for construction machines such as an unillustrated loader, and such a loader is provided with a boom (not illustrated) capable of moving up and down and attached to the front part of the loader, and a hydraulically actuated component such as a bucket (not illustrated) is attached to the leading end of the boom. The boom is operated by the boom cylinder 3. This boom is raised when a pressure fluid is supplied to a head-side chamber 3*a* of a boom cylinder 3 and is lowered when a pressure fluid is supplied to a rod-side chamber 3*b*. The bucket is driven by the bucket cylinder 4. The bucket performs dumping (forward tilting) as a pressure fluid is supplied to a head-side chamber 4*a* of a bucket cylinder 4, and is moved in the scooping direction (backward tilting) as a pressure fluid is supplied to a rod-side chamber 3*b*.

As shown in FIG. 1, the stack valve 1 includes a boom direction switching valve 11, a bucket direction switching valve 12, an ascending dividing valve 14, an ascending cancellation switching valve 19, a descending dividing valve 15, a descending cancellation switching valve 20, an ascending sequence valve 16, a descending sequence valve 17, a float electromagnetic valve mechanism 18, and a service valve 13. The stack valve 1 is connected to a pump 2 which is a fluid pressure source, a boom cylinder 3 which drives the boom, a bucket cylinder 4 which drives the bucket, and a tank 5 to which fluid returns, via a port 51, ports 52 and 53, ports 54 and 55, and a port 60, respectively. In addition to these ports, the stack valve 1 further includes ports such as ports 56, 57, 58, 59, 61, 62, and 63.

Furthermore, the pump 2 is connected to an unloading path 21 via the port 51, and the tank 5 is connected to a tank path 22 via the port 60. The port 63 provided at the most downstream part of the unloading path 21 is connected to another valve (not illustrated) according to need.

The boom direction switching valve 11 is connected to the unloading path 21 to control the supply of the pressure fluid from the pump 2 to the boom cylinder 3. The bucket direction switching valve 12 is connected to the unloading path 21 at a position downstream of the boom direction switching valve 11 to control the supply of the pressure fluid from the pump 2 to the bucket cylinder 4. The service valve 13 is connected to the unloading path 21 at a position downstream of the bucket direction switching valve 12 to control the supply of a pressure fluid to hydraulic equipments connected to the ports 58 and 59, according to need. The boom direction switching valve 11, the bucket direction switching valve 12, and the service valve 13 are connected in series by the unloading path 21.

The boom direction switching valve 11 is connected to an ascending junction path 23. The ascending junction path 23 is a path which supplies at least a part of the return pressure fluid to the head-side chamber 4*a* of the bucket cylinder 4 via the rod-side chamber 3*b* of the boom cylinder 3 and the boom direction switching valve 11.

The ascending junction path 23 is provided with the ascending dividing valve 14 which controls the flow rate of the pressure fluid supplied to the head-side chamber 4*a* of the bucket cylinder 4. The ascending junction path 23 upstream of the ascending dividing valve 14 is provided with a variable throttle 31, and this variable throttle 31 adjusts the split ratio between the flow rate of the pressure fluid supplied to the head-side chamber 4*a* of the bucket cylinder 4 and the flow rate of the pressure fluid flowing into the unloading path 21.

The stack valve 1 is provided with an ascending branched path 24 which is branched from the ascending junction path 23 and connected to the unloading path 21, and this ascending branched path 24 is provided with an ascending cancellation switching valve 19 which opens or closes the ascending branched path 24. The ascending cancellation switching valve 19 closes the ascending branched path 24 when it is at a leveling active position 19*a*, and opens the ascending branched path 24 when it is at a leveling cancellation position 19*b*. The ascending branched path 24 may be branched from the ascending junction path 23 and connected to the tank path 22.

In addition to the above, the descending junction path 25 downstream of the ascending dividing valve 14 is connected to an ascending sequence valve 16. This ascending sequence valve 16 is provided for improving the accuracy of the bucket parallel movement, and controls the flow rate of the pressure fluid flowing out from the rod-side chamber 4*b* of the bucket cylinder 4.

The boom direction switching valve 11 is connected to the descending junction path 25. The descending junction path 25 supplies at least a part of the return pressure fluid to the rod-side chamber 4*b* of the bucket cylinder 4 via the head-side chamber 3*a* of the boom cylinder 3 and the boom direction switching valve 11.

The descending junction path 25 is provided with the descending dividing valve 15 which controls the flow rate of the pressure fluid supplied to the rod-side chamber 4*b* of the bucket cylinder 4. The descending junction path 25 upstream of the descending dividing valve 15 is provided with a variable throttle 32, and this variable throttle 32 adjusts the split ratio between the flow rate of the pressure fluid supplied to the rod-side chamber 4*b* of the bucket cylinder 4 and the flow rate of the pressure fluid flowing into the unloading path 21.

In addition to the above, the stack valve 1 is provided with a descending branched path 26 which is branched from the descending junction path 25 and connected to the unloading path 21, and this descending branched path 26 is provided with a descending cancellation switching valve 20 which closes or opens the descending branched path 26. The descending cancellation switching valve 20 closes the descending branched path 26 when it is at a leveling active position 20*a*, and opens the descending branched path 26 when it is at a leveling cancellation position 20*b*. Alternatively, the descending branched path 26 may be branched from the descending junction path 25 and connected to the tank path 22.

In addition to the above, the ascending junction path 23 downstream of the descending dividing valve 15 is connected to the descending sequence valve 17. The descending sequence valve 17 is provided for improving the accuracy of the bucket parallel movement, and controls the flow rate of the pressure fluid flowing out from the head-side chamber 4*a* of the bucket cylinder 4.

In addition to the above, the stack valve 1 is provided with the float electromagnetic valve mechanism 18 which connects the head-side chamber 3*a* and the rod-side chamber 3*b* of the boom cylinder 3 with the tank path 22. The float electromagnetic valve mechanism 18 includes an electromagnetic switching valve 33, a switching valve 34 which is operated by the electromagnetic switching valve 33 and connects the rod-side chamber 3*b* of the boom cylinder 3 with the tank path 22, and a switching valve 35 which is operated by the electromagnetic switching valve 33 and connects the head-side chamber 3*a* of the boom cylinder 3 with the tank path 22. It is noted that the paths in the stack valve 1 are provided with relief valves 41 and 42*a*-42*f* at predetermined parts, for the purpose of adjustment of fluid pressures.

(Structure of Stack Valve)

Figure 2:
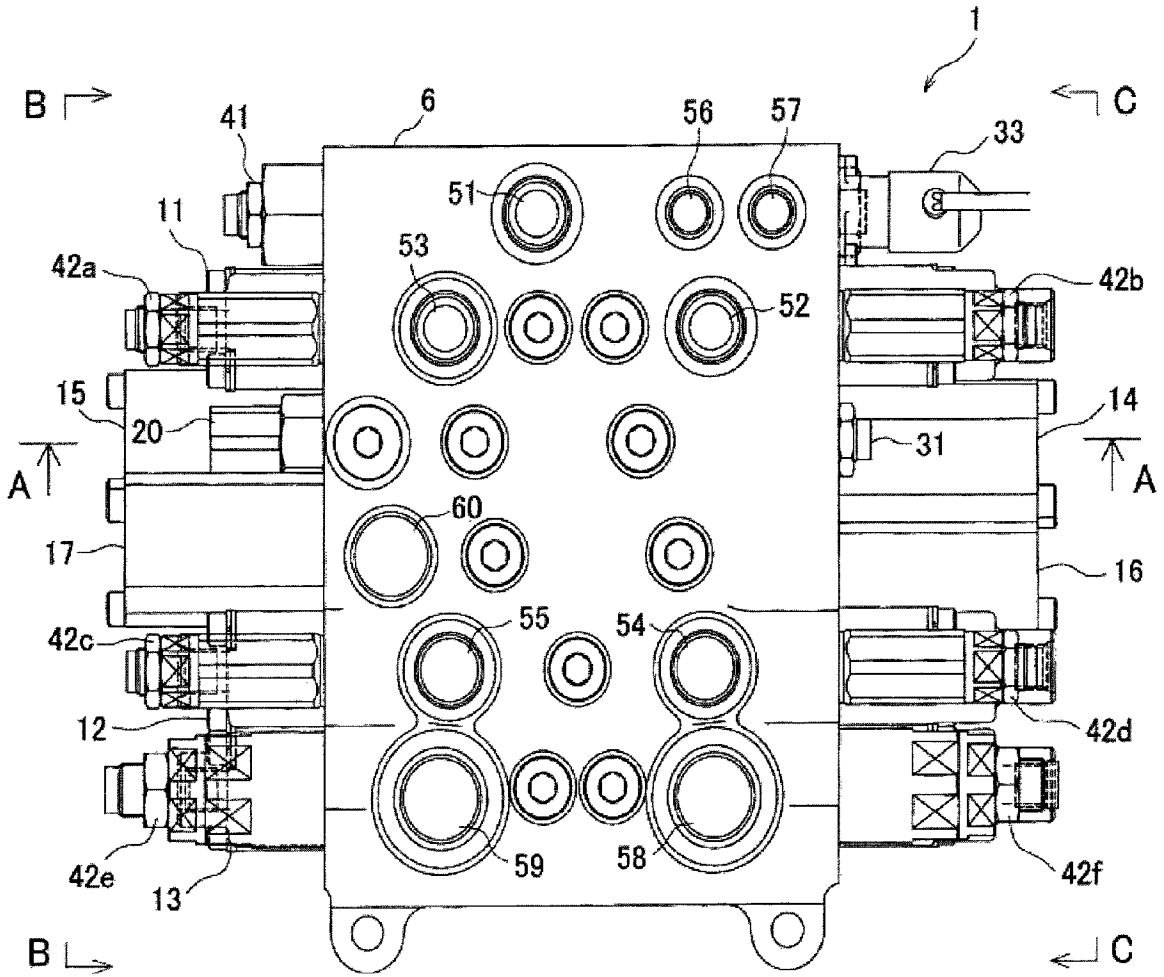
FIG. 2 is a plan view of the stack valve of FIG. 1.
Figure 3:
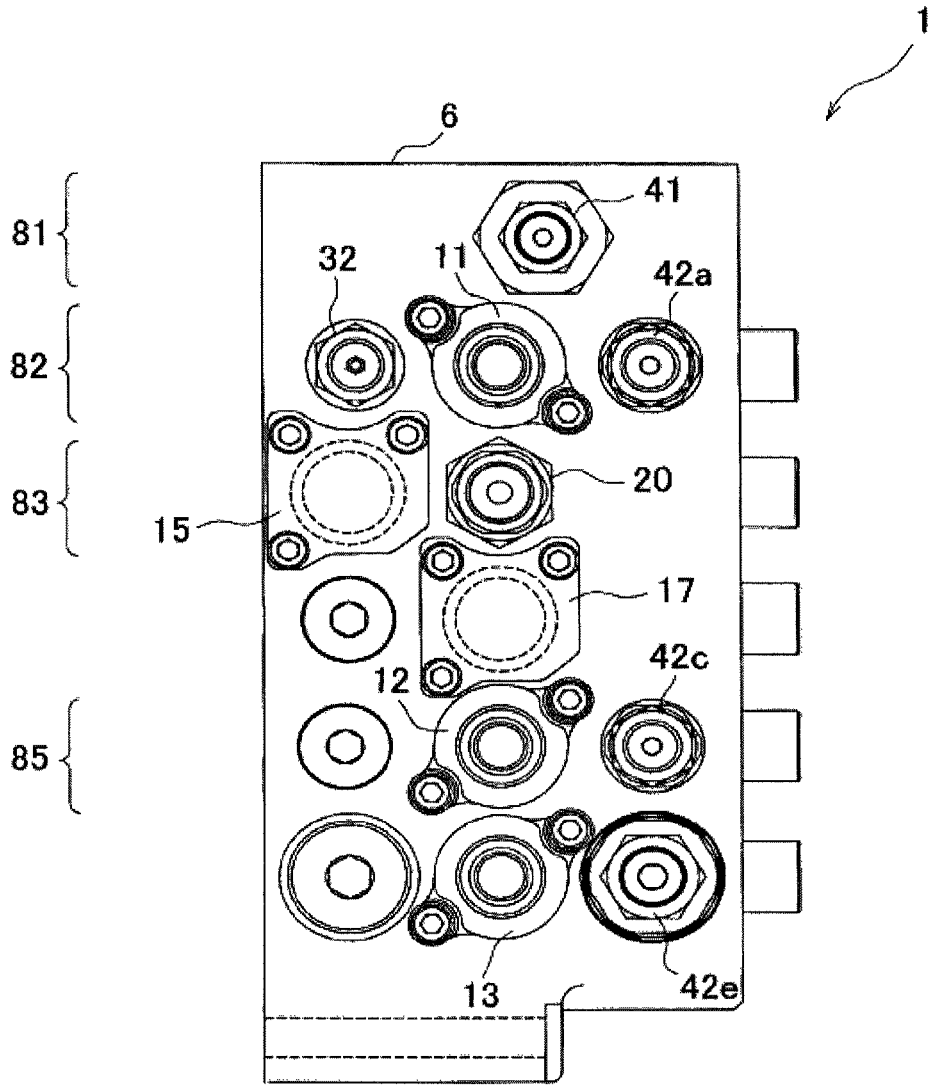
FIG. 3 is a profile of the stack valve of FIG. 2 viewed along the B-B direction.
Figure 4:
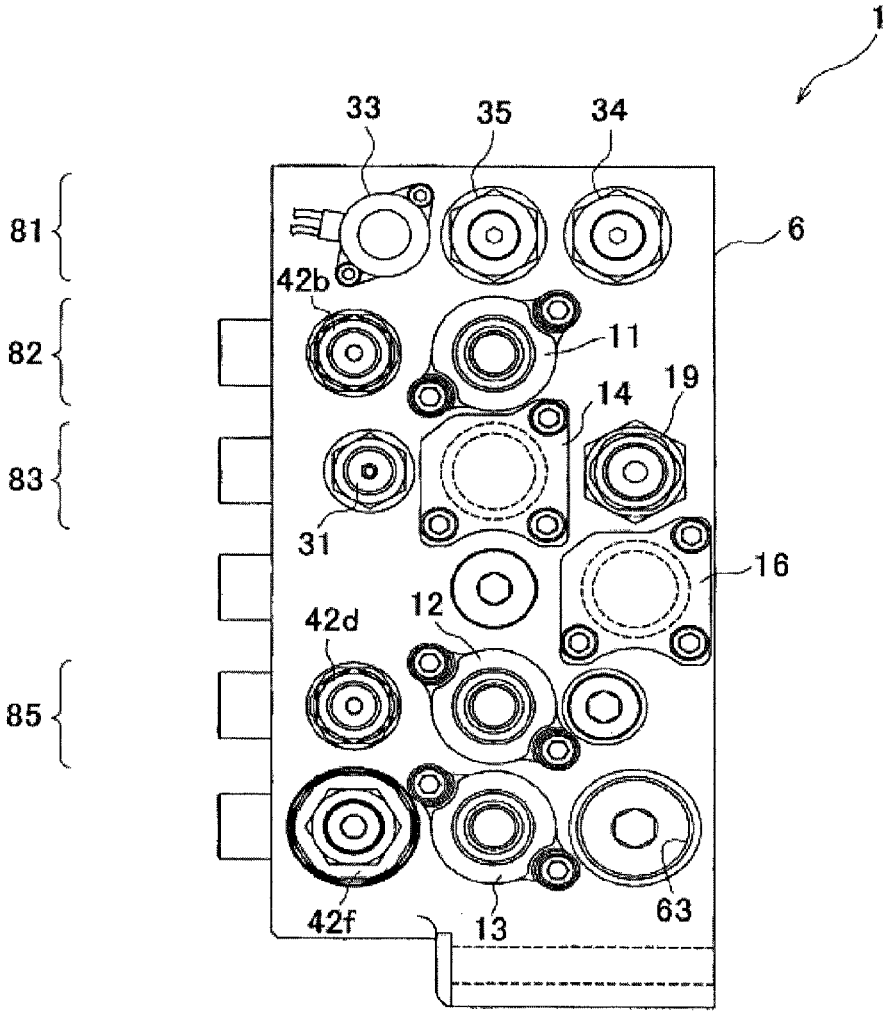
FIG. 4 is a profile of the stack valve of FIG. 2 viewed along the C-C direction.
Figure 5:
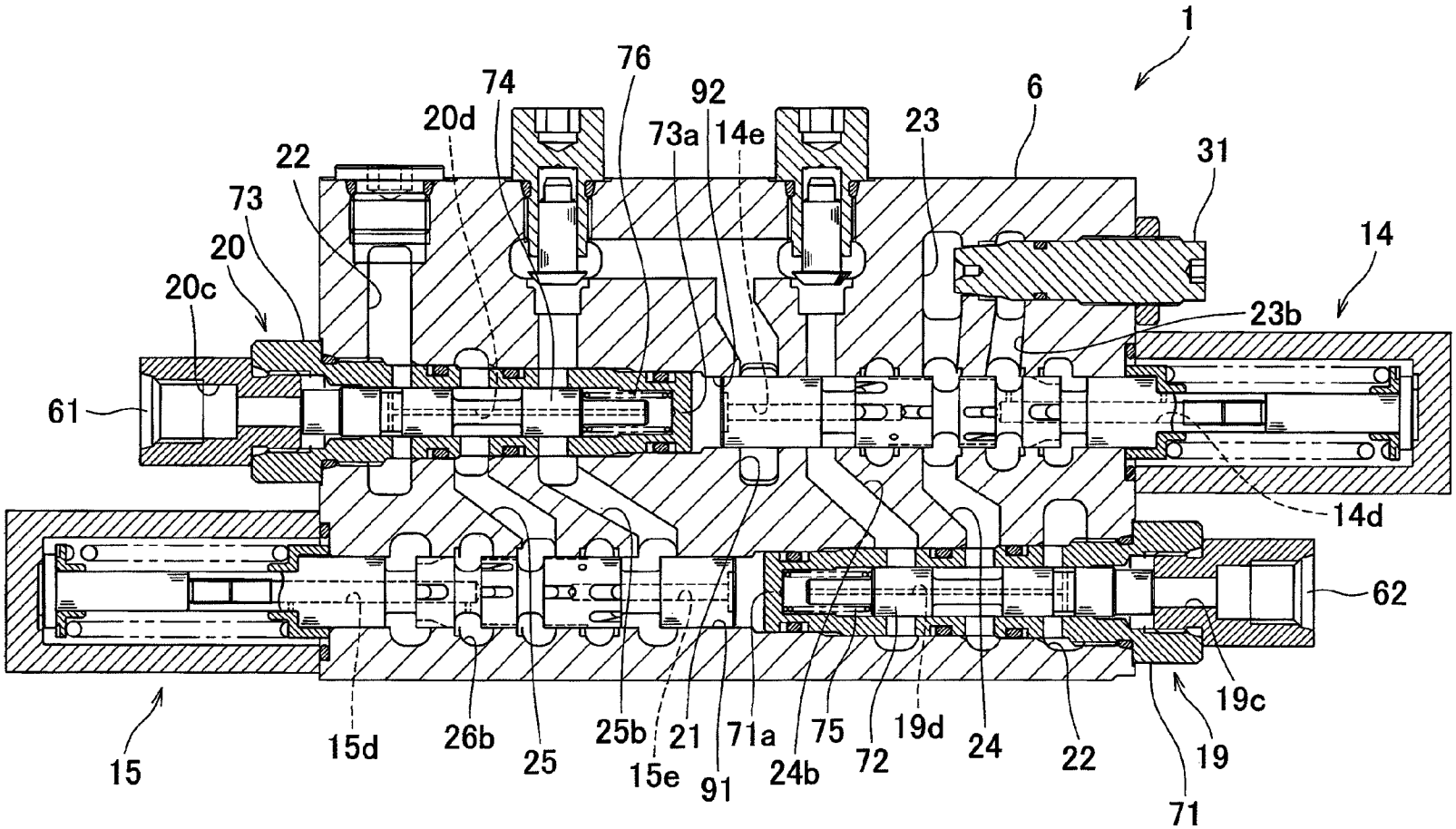
FIG. 5 is a cross section of the stack valve of FIG. 2 taken at the A-A line.

FIG. 2 is a plan view of the stack valve 1 of FIG. 1. FIG. 3, FIG. 4, and FIG. 5 are a profile viewed along the B-B direction, a profile viewed along the C-C direction, and a cross section taken at the A-A line, respectively, of the stack valve 1 shown in FIG. 2. In FIGS. 2 to 5, the components identical with or equivalent to those shown in FIG. 1 have the same reference numerals.

As shown in FIG. 2 to FIG. 4, the stack valve 1 has a rectangular parallelepiped valve main body 6, and the ports 51-60 are formed on a surface of the valve main body 6. From the profile of the valve main body 6 viewed along the B-B direction, the edges of the components such as the relief valve 41, the boom direction switching valve 11, the descending dividing valve 15, the descending cancellation switching valve 20, the descending sequence valve 17, the bucket direction switching valve 12, and the service valve 13 protrude. On the other hand, from the profile of the valve main body 6 viewed along the C-C direction, the edges of the components such as the float electromagnetic switching valve 33, the boom direction switching valve 11, the ascending dividing valve 14, the ascending cancellation switching valve 19, the ascending sequence valve 16, the bucket direction switching valve 12, and the service valve 13 protrude. The valve main body 6 is formed by casting.

The stack valve 1 is, from its one side to the other side, divided into the following six sections: a float section 81 where the float electromagnetic switching valve 33 is provided; a boom section 82 where the boom direction switching valve 11 is provided; a dividing section 83 where the dividing valves 14 and 15 are provided; a sequence section where the sequence valves 16 and 17 are provided; a bucket section where the bucket direction switching valve 12 is provided; and a service section where the service valve 13 is provided. It is noted that both of the ascending cancellation switching valve 19 and the descending cancellation switching valve 20 are provided in the dividing section 83.

FIG. 5 is a cross section of the dividing section 83. As shown in FIG. 5, the ascending dividing valve 14 and the descending dividing valve 15 are spaced from each other in the dividing section 83 with a predetermined distance therebetween and are in parallel to each other. The ascending dividing valve 14 and the descending cancellation switching valve 20 are on a single axis, whereas the descending dividing valve 15 and the ascending cancellation switching valve 19 are on a single axis.

The ascending dividing valve 14 and the ascending cancellation switching valve 19 are provided on one side of the dividing section 83, whereas the descending dividing valve 15 and the descending cancellation switching valve 20 are provided on the other side of the dividing section 83. That is to say, the ascending dividing valve 14 and the ascending cancellation switching valve 19 are vertically arranged in the dividing section 83 to be adjacent to each other, whereas the descending dividing valve 15 and the descending cancellation switching valve 20 are vertically arranged in the dividing section 83 to be adjacent to each other. This arrangement simplifies the ascending junction path 23 and the ascending branched path 24 connecting the ascending dividing valve 14 with the ascending cancellation switching valve 19. The arrangement above also simplifies the descending junction path and the descending branched path 26 connecting the descending dividing valve 15 with the descending cancellation switching valve 20.

The ascending cancellation switching valve 19 includes a spool 72, a spring 75 provided at the end portion of the spool 72, and a cup-shaped plug 71 having a spool hole therein to house the spool 72 and the spring 75. This cup-shaped plug 71 is formed to be long in a predetermined direction. In this connection, at a part of the valve main body 6 in which part the ascending cancellation switching valve 19 and the descending dividing valve 15 are provided on a single axis, a spool hole 91 having a substantially same diameter is provided on a substantially same axis. The plug 71 is inserted into this spool hole 91 and is attached to the valve main body 6 partly by screwing. The thickness of the plug 71 is determined in accordance with the external diameter of the spool 72. The ascending cancellation switching valve 19 and the descending dividing valve 15 on the same axis are bordered with each other at the bottom portion 71*a* of the plug 71.

The bottom portion 71*a* of the plug 71 can be seen as a partition wall formed in the spool hole 91 of the descending dividing valve 15, and the ascending cancellation switching valve 19 is provided on one side of the partition wall whereas the descending dividing valve 15 is provided on the other side of the partition wall.

This allows the ascending cancellation switching valve 19 to be provided in the dividing section 83 where the descending dividing valve 15 is provided, and the spool hole is easily formed because the space (spool hole 91) for housing the descending dividing valve 15 and the ascending cancellation switching valve 19 is formed by the same manufacturing process of making a hole into the valve main body 6. It is noted that it is extremely difficult to form a partition wall separating the ascending cancellation switching valve 19 from the descending dividing valve 15 by boring holes into the valve main body 6 from both the profile viewed along the B-B direction and from the profile viewed in the C-C direction.

Similar to the ascending cancellation switching valve 19, the descending cancellation switching valve 20 includes a spool 74, a spring 76 provided at the end portion of the spool 74, and a cup-shaped plug 73 having a spool hole therein to house the spool 74 and the spring 76. This cup-shaped plug 73 is formed to be long in a predetermined direction. In this connection, at a part of the valve main body 6 in which part the descending cancellation switching valve 20 and the ascending dividing valve 14 are provided on a single axis, a spool hole 92 having a substantially same diameter is provided on a substantially same axis. The plug 73 is inserted into this spool hole 92 and is attached to the valve main body 6 partly by screwing. The thickness of the plug 73 is determined in accordance with the external diameter of the spool 74. The descending cancellation switching valve 20 and the ascending dividing valve 14 on the same axis are bordered with each other at the bottom portion 73*a* of the plug 73.

The bottom portion 73*a* of the plug 73 can be seen as a partition wall formed in the spool hole 92 of the ascending dividing valve 14, and the ascending dividing valve 14 is provided on one side of the partition wall whereas the descending cancellation switching valve 20 is provided on the other side of the partition wall.

This allows the descending cancellation switching valve 20 to be provided in the dividing section 83 where the ascending dividing valve 14 is provided, and the spool hole is easily formed because the space (spool hole 92) for housing the ascending dividing valve 14 and the descending cancellation switching valve 20 is formed by the same manufacturing process of making a hole into the valve main body 6. It is noted that it is extremely difficult to form a partition wall separating the ascending dividing valve 14 from the descending cancellation switching valve 20 by boring holes into the valve main body 6 from both the profile viewed along the B-B direction and from the profile viewed in the C-C direction.

(Operation of Stack Valve)

Now, the operation of the stack valve 1 will be described with reference to FIG. 1. The boom direction switching valve 11 is arranged to be switchable between three positions, namely, an ascending position 11*a*, a neutral position 11*b*, and a descending position 11*c*. At the neutral position 11*b*, the valve 11 opens the unloading path 21 and closes the ascending junction path 23, the descending junction path 25, and the boom cylinder 3. At the ascending position 11*a*, the valve 11 supplies the pressure fluid from the pump 2 to the head-side chamber 3*a* of the boom cylinder 3, and connects the rod-side chamber 3*b* with the ascending junction path 23. As a result, when the boom is raised by supplying a pressure fluid to the head-side chamber 3*a* of the boom cylinder 3, the return pressure fluid from the rod-side chamber 3*b* of the boom cylinder 3 is supplied to the head-side chamber 4*a* of the bucket cylinder 4, with the result that the bucket is kept to be in parallel to the horizontal plane.

This bucket parallel movement function for the boom rising is activated when the ascending branched path 24 is closed, i.e. the ascending cancellation switching valve 19 is at the leveling active position 19*a*. In the meanwhile, when the ascending cancellation switching valve 19 is switched to the leveling cancellation position 19*b*, the ascending branched path 24 is connected to the unloading path 21 and hence the pressure fluid pressure-supplied to the ascending junction path 23 via the boom direction switching valve 11 from the rod-side chamber 3*b* of the boom cylinder 3 flows out from the ascending branched path 24, and the supply of the pressure fluid to the head-side chamber 4*a* of the bucket cylinder 4 is stopped. In short, the bucket parallel movement function is cancelled.

When the boom direction switching valve 11 is switched to the descending position 11*c*, the pressure fluid from the pump 2 is supplied to the rod-side chamber 3*b* of the boom cylinder 3 and connects the head-side chamber 3*a* with the descending junction path 25. As a result, when the boom is lowered by supplying a pressure fluid to the rod-side chamber 3*b* of the boom cylinder 3, the return pressure fluid from the head-side chamber 3*a* of the boom cylinder 3 is supplied to the rod-side chamber 4*b* of the bucket cylinder 4, with the result that the bucket is kept to be in parallel to the horizontal plane.

This bucket parallel movement function for the boom lowering is activated when the descending branched path 26 is closed, i.e. when the descending cancellation switching valve 20 is at the leveling active position 20*a*. In the meanwhile, when the descending cancellation switching valve 20 is switched to the leveling cancellation position 20*b*, the descending branched path 26 is connected to the unloading path 21 and hence the pressure fluid supplied from the head-side chamber 3*a* of the boom cylinder 3 via the boom direction switching valve 11 to the descending junction path 25 flows out from the descending branched path 26, and the supply of the pressure fluid to the rod-side chamber 4*b* of the bucket cylinder 4 is stopped.

In short, the bucket parallel movement function is cancelled.

When the electromagnetic switching valve 33 of the float electromagnetic valve mechanism 18 is activated, the switching valve 34 and the switching valve 35 are switched to the connection state irrespective of the current position of the boom direction switching valve 11, and hence the rod-side chamber 3*b* and the head-side chamber 3*a* of the boom cylinder 3 are connected to the tank path 22. As such, when for example an operation such as grading is performed, the loader runs while the electromagnetic switching valve 33 is activated and the bucket is kept on the ground. The boom cylinder in such a case is arranged so that the rod-side chamber 3*a* and the head-side chamber 3*b* are connected to the tank path 22, and hence the boom is raised and lowered in accordance with the irregularities of the ground. This makes it easy to perform operations such as grading.

The bucket direction switching valve 12 is arranged to be switchable between a scooping position 12*a*, a neutral position 12*b*, and a dumping position 12*c*. At the scooping position 12*a*, the rod-side chamber 4*b* of the bucket cylinder 4 is connected to the pump 2 and the head-side chamber 4*a* of the bucket cylinder 4 is connected to the unloading path 21, to move the bucket in the scooping direction. At the neutral position 12*b*, only the unloading path 21 is connected. At the dumping position 12*c*, the head-side chamber 4*a* is connected to the pump 2 and the rod-side chamber 4*b* is connected to the unloading path 21, to cause the bucket to perform dumping.

As described above, from the stack valve 1 is eliminated a section for the switching valves 19 and 20 which are used for canceling the bucket parallel movement function, because the switching valves 19 and 20 are provided in the same dividing section as the dividing valves 14 and 15. This makes it possible to restrain the upsizing of the stack valve as compared to conventional arrangements, even if new functions such as the ascending sequence valve 16, the descending dividing valve 15, and the float electromagnetic valve mechanism 18 are added to the stack valve as in the present embodiment. In other words, it is possible to realize a small-sized stack valve having the bucket parallel movement function.

While illustrative and presently preferred embodiment of the present invention has been described in detail herein, it is to be understood that the inventive concepts may be otherwise variously embodied and employed within the scope of the appended claims.

REFERENCE NUMERALS

1: STACK VALVE
2: PUMP (FLUID PRESSURE SOURCE)
3: BOOM CYLINDER
4: BUCKET CYLINDER
5: TANK
11: BOOM DIRECTION SWITCHING VALVE
12: BUCKET DIRECTION SWITCHING VALVE
14: ASCENDING DIVIDING VALVE
19: ASCENDING CANCELLATION SWITCHING VALVE
21: UNLOADING PATH
22: TANK PATH
23: ASCENDING JUNCTION PATH
24: ASCENDING BRANCHED PATH
82: BOOM SECTION
83: DIVIDING SECTION
85: BUCKET SECTION

The invention claimed is:

1. A stack valve having a bucket parallel movement function, comprising:

an unloading path connected to a fluid pressure source, a tank path connected to a tank;

a boom direction switching valve which is provided in a boom section and connected to the unloading path to control supply of a pressure fluid from the fluid pressure source to a boom cylinder;

a bucket direction switching valve which is provided in a bucket section and connected to the unloading path to control supply of the pressure fluid from the fluid pressure source to a bucket cylinder;

an ascending junction path which supplies the pressure fluid from a rod-side chamber of the boom cylinder to a head-side chamber of the bucket cylinder via the boom direction switching valve;

an ascending dividing valve which is provided in a dividing section and connected to the ascending junction path to control a flow rate of the pressure fluid supplied to the head-side chamber of the bucket cylinder;

an ascending branched path which is branched from the ascending junction path and connected to the unloading path or the tank path;

a ascending cancellation switching valve which is provided in the dividing section and connected to the ascending branched path to open or close the ascending branched path;

a descending junction path which supplies the pressure fluid from a head-side chamber of the boom cylinder to the rod-side chamber of the bucket cylinder via the boom direction switching valve;

a descending dividing valve which is provided in the dividing section and on the descending junction path to control a flow rate of the pressure fluid supplied to the rod-side chamber of the bucket cylinder;

a descending branched path which is branched from the descending junction path and connected to the unloading path or the tank path; and a descending cancellation switching valve which is provided in the dividing section and on the descending branched path to open or close the descending branched path, wherein, the descending dividing valve and the ascending dividing valve are arranged to be in parallel to each other, the ascending dividing valve is provided on one side of the dividing section whereas the descending dividing valve is provided on the other side of the dividing section, and the ascending cancellation switching valve is provided on the same axis as the descending dividing valve and in the one side of the dividing section.

2. The stack valve according to claim 1, wherein, the ascending cancellation switching valve has a cup-shaped plug in which a spool hole is formed, and the descending dividing valve and the ascending cancellation switching valve on the same axis are bordered with each other at a bottom portion of the plug.

3. A stack valve having a bucket parallel movement function, comprising:

an unloading path connected to a fluid pressure source;

a tank path connected to a tank;

a boom direction switching valve which is provided in a boom section and connected to the unloading path to control supply of a pressure fluid from the fluid pressure source to a boom cylinder;

a bucket direction switching valve which is provided in a bucket section and connected to the unloading path to control supply of the pressure fluid from the fluid pressure source to a bucket cylinder;

a descending junction path which supplies the pressure fluid from a head-side chamber of the boom cylinder to a rod-side chamber of the bucket cylinder via the boom direction switching valve;

a descending dividing valve which is provided in a dividing section and on the descending junction path to control a flow rate of the pressure fluid supplied to the rod-side chamber of the bucket cylinder;

a descending branched path which is branched from the descending junction path and connected to the unloading path or the tank path;

a descending cancellation switching valve which is provided in the dividing section and on the descending branched path to open or close the descending branched path;

an ascending junction path which supplies the pressure fluid from the rod-side chamber of the boom cylinder to the head-side chamber of the bucket cylinder via the boom direction switching valve;

an ascending dividing valve which is provided in the dividing section and on the ascending junction path to control a flow rate of the pressure fluid supplied to the head-side chamber of the bucket cylinder;

an ascending branched path which is branched from the ascending junction path and connected to the unloading path or the tank path; and an ascending cancellation switching valve which is provided in the dividing section and on the ascending branched path to open or close the ascending branched path, wherein, the descending dividing valve and the ascending dividing valve are arranged to be in parallel to each other, the ascending dividing valve is provided on one side of a dividing section whereas the descending dividing valve is provided on the other side of the dividing section, and the descending cancellation switching valve is on the same axis as the ascending dividing valve and is provided in the other side of the dividing section.

4. The stack valve according to claim 3, wherein, the descending cancellation switching valve has a cup-shaped plug in which a spool hole is formed, and the ascending dividing valve and the descending cancellation switching valve on the same axis are bordered with each other at a bottom portion of the plug.

* * * * *